US005410811A

United States Patent [19]

Wolf et al.

[11] Patent Number: 5,410,811

[45] Date of Patent: May 2, 1995

[54] DRY SHAVING APPARATUS WITH A PIVOTALLY MOUNTED SHAVING HEAD ASSEMBLY

[75] Inventors: Jürgen Wolf, Kriftel; Michael Odemer, Frankfurt, both of Germany

[73] Assignee: Braun Aktiengesellschaft, Frankfurt, Germany

[21] Appl. No.: 191,985

[22] Filed: Feb. 4, 1994

[30] Foreign Application Priority Data

Feb. 11, 1993 [DE] Germany ..... 43 03 972.3

[51] Int. Cl.[6] ..... B26B 19/12

[52] U.S. Cl. ..... 30/43.9; 30/43.92

[58] Field of Search ..... 30/43.7, 43.8, 43.9, 30/43.91, 43.92, 346.51

[56] References Cited

U.S. PATENT DOCUMENTS

| | | | |
|---|---|---|---|
| 4,796,359 | 1/1989 | Oprach et al. | 30/43.92 |
| 4,922,608 | 5/1990 | Pahl | 30/43.91 |
| 4,930,217 | 6/1990 | Wolf et al. | 30/43.92 |
| 5,163,227 | 11/1992 | Wolf et al. | 30/43.92 |
| 5,185,933 | 2/1993 | Messinger | 30/43.92 |
| 5,201,781 | 4/1993 | Jestädt et al. | 30/43.92 |
| 5,233,746 | 8/1993 | Heintke | 30/43.1 |
| 5,235,749 | 8/1993 | Hildebrand et al. | 30/43.92 |
| 5,245,754 | 9/1993 | Heintke et al. | 30/43.92 |
| 5,257,456 | 11/1993 | Franke et al. | 30/43.92 |
| 5,289,636 | 3/1994 | Eichhorn et al. | 30/43.92 |

OTHER PUBLICATIONS

"Braun Flex Control 4510 Universal" dry shaver, publisher's imprint 5-584-014/VI-92, dated before Feb. 11, 1993.

*Primary Examiner*—Hwei Siu Payer
*Attorney, Agent, or Firm*—Fish & Richardson

[57] ABSTRACT

A dry shaving apparatus including a housing having two plastic support lugs, and a shaving head assembly arranged between the two support lugs. The shaving head assembly includes a plastic shaving head frame, at least one outer cutter, and at least one inner cutter operatively associated with the outer cutter. The shaving head assembly is mounted on the support lugs in a manner pivotal about a pivot axis by means of bearing screws. The shaving apparatus also includes two biased springs and two metal bearing elements, wherein each of bearing elements is provided with a thread, is fixedly arranged in a respective one of the support lugs, and has an end surface facing the shaving head frame. Each of the bearing screws is in fixed threaded engagement with a respective one of the bearing elements to form pivot bearings for the shaving head frame, and wherein the shaving head frame is held in abutment with the end surface of each of the bearing elements by a respective one of the biased springs which has one of its ends against the respective bearing screw while its other end takes support upon the shaving head frame.

13 Claims, 3 Drawing Sheets

DRY SHAVING APPARATUS WITH A PIVOTALLY MOUNTED SHAVING HEAD ASSEMBLY

This invention relates to a dry shaving apparatus having a housing and a shaving head assembly which is arranged between two support lugs provided on the housing and is comprised of a shaving head frame and at least one outer cutter and at least one inner cutter operatively associated with the outer cutter, and which is mounted on the support lugs in a manner pivotal about a pivot axis Z by means of bearing screws.

A dry shaving apparatus of the type initially referred to is known from the operating instructions for the commercially available "Braun Flex Control 4510 universal" dry shaver, publisher's imprint 5-584-014/VI-92. In this known dry shaving apparatus, the shaving head frame and the support lugs provided for its pivotal mounting are made of metal.

It is an object of the present invention to reduce the manufacturing cost of a dry shaving apparatus of the type initially referred to without impairing the pivotal function of the pivotally mounted shaving head assembly.

According to the present invention, this object is accomplished in a dry shaving apparatus of the type referred to in the foregoing in that the support lugs and the shaving head frame are made of a plastics material, that a bearing element made of metal and provided with a thread is fixedly arranged in the support lugs, that the pivot bearings of the shaving head frame are provided by the bearing screw which is in fixed threaded engagement with the bearing element, and that the shaving head frame is held in abutment with a respective end surface of the respective bearing element facing the pivotal frame by a respective biased spring means resting with one end against the bearing screw while its other end takes support upon the pivotal frame.

The particular advantages that may be derived from the present invention, such as the reduced manufacturing cost and the lower weight of the dry shaving apparatus, result from the use of plastics material in lieu of metal for the support lugs and the shaving head frame, in combination with the further means indicated regarding the configuration of the pivot bearings for the pivotal shaving head assembly.

The shaving head frame made of a plastics material and the support lugs equally made of plastics and provided with bearing elements made of metal are first clamped against each other at each end with a defined force by means of the bearing screws and the spring means. The ensuing material-induced yield behavior of the plastic components, as the support lugs and the shaving head frame which are thus subjected to tension, is continuously compensated for by the biased spring means, thereby ensuring a durable and clearance-free mounting and pivotal motion of the shaving head frame on the support lugs.

It is a further advantage of the present invention that the biased spring means compensate for all manufacturing tolerances of components axially arranged adjacent to each other or abutting each other, such as the support lugs, the bearing elements, the pivotal frame, the spring means and the bearing screws, whereby a clearance-free mounting of the shaving head frame on the support lugs is ensured automatically already after these components are assembled together.

In a further feature of the present invention, the bearing screw is comprised of a head portion, a bearing portion, a stop portion and a thread portion, and the bearing portion is provided with a stop portion for abutment with the stop portion of the bearing screw. The essential advantage of this configuration of bearing screw and bearing element resides in that the bearing screw is securely fastened within the bearing element and arranged therein in a defined position following its threaded engagement in the bearing element until the stop portions provided are in firm mutual abutment.

In a still further feature of the present invention, the end surface of the bearing element protrudes from the wall of the support lug in the direction of the shaving head frame. By virtue of the portion of the bearing element protruding from the wall of the support lug and abutting with its end surface the outer wall of the pivotal shaving head frame, a friction-free distance is obtained between the respective walls of the shaving head frame and the support lugs, the respective end surfaces of the bearing screws providing a counter-support for the shaving head frame with a minimum friction surface.

In a preferred embodiment of the present invention, the spring means is arranged between an end wall inner surface of the shaving head frame pivotally mounted on the bearing portion of the bearing screw and the head portion of the bearing screw. For implementation of this embodiment, a space for arranging and performing the function of a biased spring means is provided between the head portion of the bearing screw fixedly threaded into the bearing element and the inside of the end wall of the shaving head frame pivotally mounted on the bearing portion of the bearing screw.

By virtue of the spring means which has its one end resting against the head portion of the bearing screw while its other end is biased into engagement with the end wall inner surface of the shaving head frame, the shaving head frame is durably held in engagement with the end surface of the bearing element secured in the supporting member. By this means, immediately following the assembly of the above-mentioned components, a clearance-free bearing of the shaving head frame on the bearing screw will be realized in an axial direction while manufacturing tolerances, if any, are compensated for, and the yield behavior subsequently ensuing due to the plastics material of the components subjected to tension by the spring means will be balanced out continuously without the pivotal function of the shaving head frame being impaired.

In a preferred embodiment of the present invention affording economy and ease of assembly, the spring means is configured as a leaf spring having a bifurcated portion embracing the bearing portion of the bearing screw and resting against the head portion of the bearing screw, and an angled spring leg abutting a wall of the shaving head frame.

In a further embodiment of the present invention, the spring means is configured as a spiral spring.

Further advantageous embodiments of the present invention will become apparent from the subclaims 7 to 13.

An embodiment of the present invention will now be described in the following with reference to the accompanying drawings, in which.

Figure 1:
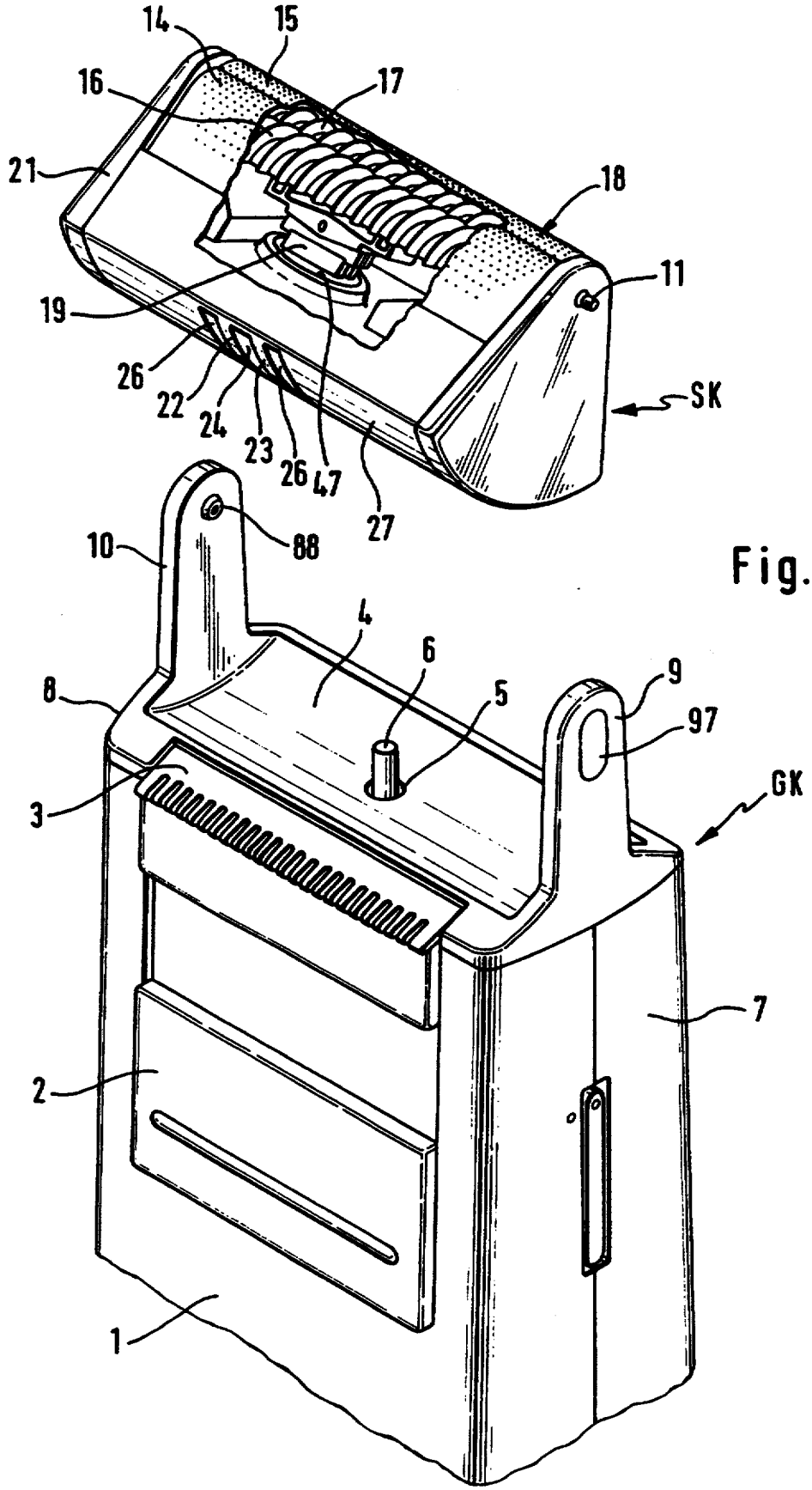
FIG. 1 is a perspective view of a portion of a dry shaving apparatus showing the shaving head in detached position.

Referring now to FIG. 1 showing the upper portion of a dry shaving apparatus, reference numeral 1 identifies a housing, reference numeral 2 an On/Off switch, 3 a long-hair trimmer, 4 an upper end of the shaver housing, 6 a drive pin extending out of an opening 5 in the housing upper end 4, numerals 9 and 10 designate support lugs forming an extension of respective narrow sides 7 and 8 of the housing, and SK relates to a shaving head assembly pivotally carried on bearing screws 11. The support lugs 9, 10 form a constituent part of a plastic head portion GK of the housing as shown in FIG. 1, or are integrally formed with the housing 1, as shown in FIG. 2.

The shaving head assembly SK shows a pair of parallel shaving heads 14 and 15 comprising two inner cutters 16 and 17 as well as outer cutters 18 fitted over the inner cutters 16 and 17 in arched form. The inner cutters 16 and 17 are resiliently mounted on a common coupling member 19. The coupling member 19 is coupled to a drive member 47 forming a constituent part of an oscillating bridge structure 61 carried in the shaving head frame 21—see FIG. 2. For transmitting the driving motion from the drive pin 6 to the oscillating bridge structure 61, the latter is provided with two transverse rib members 22 and 23 having a space 24 therebetween for engagement by the drive pin 6. When the drive is activated, the transverse rib members 22 and 23 of the oscillating bridge structure 61 will oscillate within an opening 26 provided in a bottom plate 27 of the shaving head frame 21.

Figure 2:
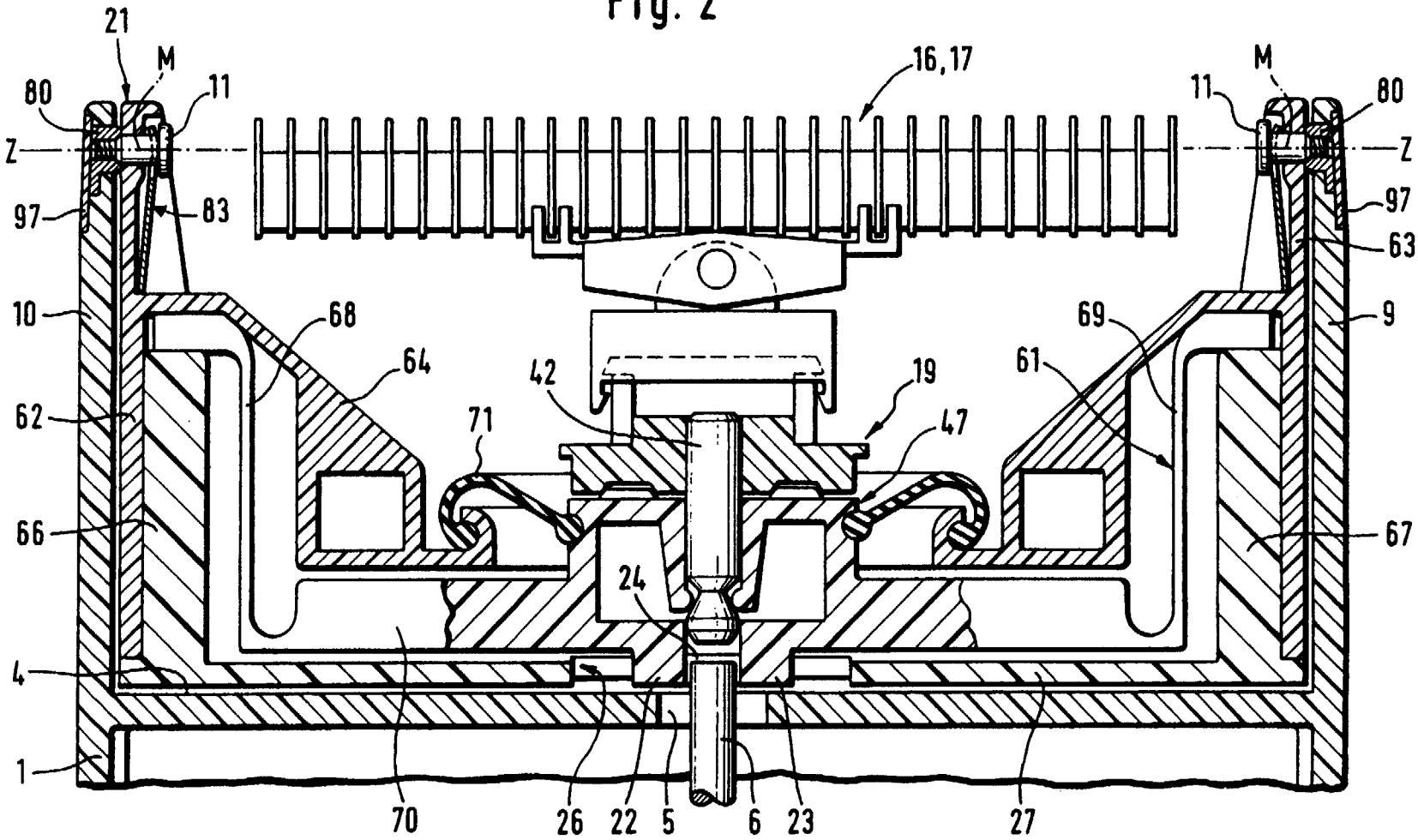
FIG. 2 is a cross-sectional view of a shaving head pivotally mounted on support lugs and of the upper portion of the housing of the dry shaver.
Figure 3:
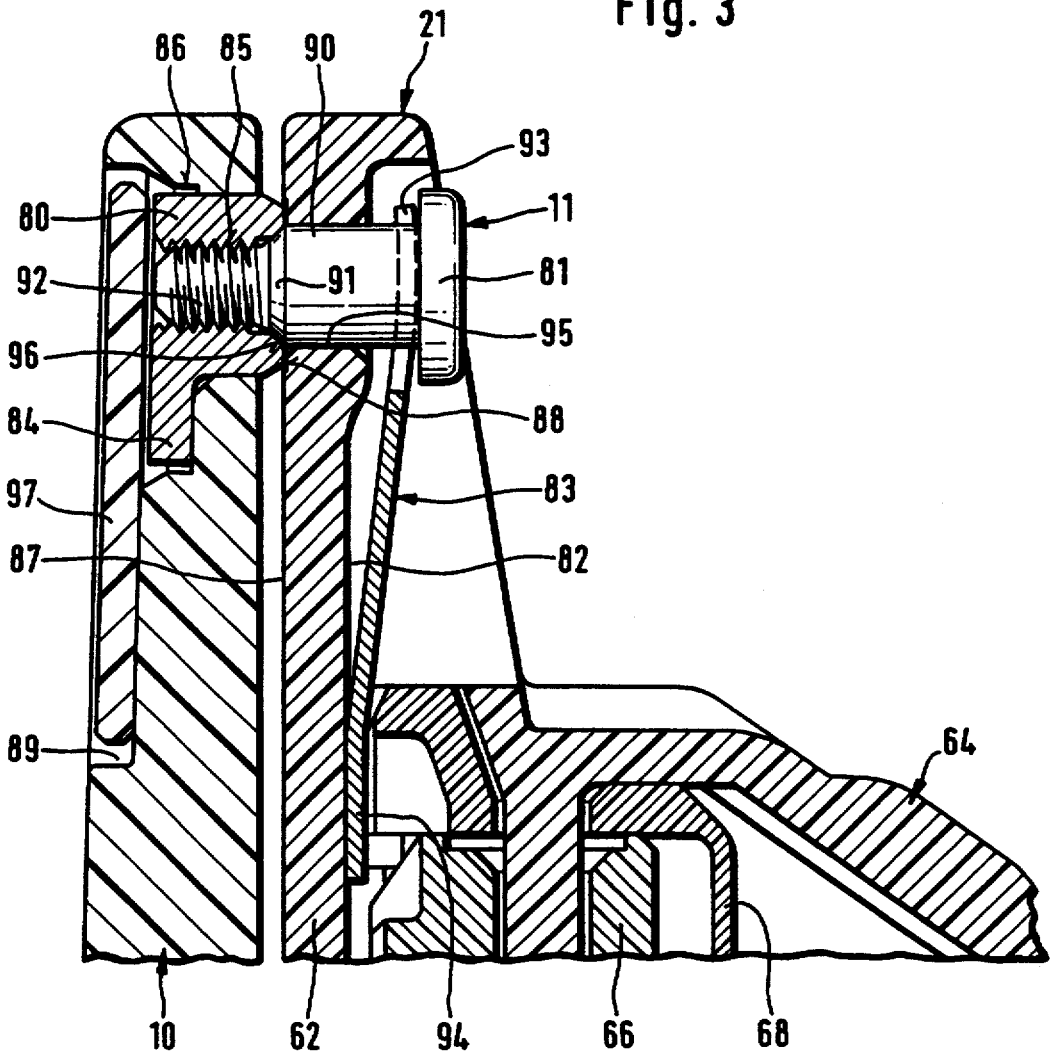
FIG. 3 is a cross-sectional view of the upper portion of a support lug and of a shaving head frame, showing the components serving to support the shaving head frame.

By analogy with FIG. 1, in FIG. 2 the housing is assigned reference numeral 1, the support lugs made of a plastics material and integrally formed with the housing carry numerals 9 and 10, and reference numeral 6 denotes the drive pin which extends out of the opening 5 in the housing upper end 4 into the space 24 between the transverse rib members 22 and 23 provided on the oscillating bridge member 61. The shaving head frame 21 made of a plastics material of which in FIG. 2 the end walls 62, 63 and the inner wall 64 extending into the interior space are shown, is pivotally mounted on the support lugs 9 and 10 by means of bearing screws 11, as shown in FIG. 3. The plastic bottom plate 27 closing the shaving head frame 21 is of a U-shaped configuration. The bottom plate 27 is provided with legs 66, 67 extending parallel to the end walls 62, 63 of the shaving head frame 21. The oscillating bridge structure 61, which is comprised of two depending spring arms 68, 69 and a plate 70 connecting the spring arms 68, 69 is secured to the upper ends of the legs 66, 67. The bottom plate 27 has an opening 26 into which the transverse rib members 22, 23 of the oscillating bridge structure 61 extend to be coupled to the drive pin 6. The drive member 47 coupled to the bearing pin 42 of the coupling member 19 is integrally formed with the plate 70, thus forming a constituent part of the oscillating bridge structure 61. A seal 71 has its one end fastened to the drive member 47 and its other end to the inner wall 64 of the shaving head frame 21.

Details of the mounting of the shaving head frame 21 on the two support lugs 9 and 10 by means of the bearing elements 80, bearing screws 11 and spring means 83 shown in FIG. 2 are illustrated in FIG. 3 and will be set out in the following.

The embodiment of FIG. 3 shows a partial sectional view of the support lug 10 made of a plastics material, the end wall 62 as well as the inner wall 64 of the plastic shaving head frame 21, and a section through the bearing element 80 made of metal and fixedly arranged in the support lug 10, and through the spring means 83 resting with one end against the head portion 81 of the bearing screw 11, while its other end takes support on the inner surface 82 of the end wall 62 of the shaving head frame 21.

The bearing element 80 which has an internal thread 85 throughout its thickness, together with the mounting flange 84 provided in this embodiment by way of example, is a firm press-fit within an opening 86 extending through part of the thickness of the support lug 10, protruding from this opening 86 by a small amount in the direction of the end wall 62 of the shaving head frame 21, so that following abutment of the outer surface 87 of the end wall 62 with the end surface 88 of the bearing element 80, a friction-free distance is established between the end wall 62 of the shaving head frame 21 and the support lug 10. A cover plate 97 arranged in a recess 89 in the support lug 10 and fixedly connected therewith by means of adhesive bonding or welding provides for additional securing of the bearing element 80 in the support lug 10.

The bearing screw 11 is comprised of a head portion 81, a bearing portion 90, a stop portion 91, and a thread portion 92 on which an external thread is provided.

In the embodiment illustrated in FIG. 3, the spring means 83 is a leaf spring comprising a bifurcated portion 93 having a U-shaped cutout, and an angled spring leg 94.

A bearing bore 95 is provided in the end wall 62 of the shaving head frame 21. As the shaving head frame 21 is mounted on the support lug 10, the bearing screw 11 is passed through the bifurcated portion 93 of the leaf spring 83 and through the bearing bore 95 of the shaving head frame 21, the external thread of its thread portion 92 then engaging with the internal thread 85 of the bearing element 80, until the stop portion 91 is in firm abutment with a stop portion 96 provided on the bearing element 80. The leaf spring 83 having its bifurcated portion 93 resting against the head portion 81 of the bearing screw 11 while its angled leg 94 rests against the inner surface 82 of the end wall 62 of the shaving head frame 21, is put under spring tension as the bearing screw 11 is threaded into the bearing element 80. By means of this spring tension, the shaving head frame 21 pivotally mounted on the bearing portion 90 of the bearing screw 11 and the support lug 10 are clamped against each other when the end surface 88 of the bearing element 80 is in abutting engagement with the end wall 62. The bearing arrangement of the shaving head frame 21 illustrated and described in FIG. 3 with reference to the support lug 10 and the end wall 62 is equally provided in the support lug 9 and the end wall 63 of the shaving head frame 21, with the pivot axis Z of the shaving head assembly SK being the respective center axis M of the bearing screws 11—see FIG. 2.

We claim:

1. A dry shaving apparatus comprising a housing having two plastic support lugs, and a shaving head assembly arranged between the two support lugs, said shaving head assembly comprising a plastic shaving head frame, at least one outer cutter, and at least one inner cutter operatively associated with the outer cutter, said shaving head assembly being mounted on the support lugs in a manner pivotal about a pivot axis by means of bearing screws, said shaving apparatus further comprising two biased springs and two metal bearing elements, wherein each of said bearing elements is provided with a thread, is fixedly arranged in a respective one of the support lugs, and has an end surface facing the shaving head frame, wherein each of the bearing screws is in fixed threaded engagement with a respective one of said bearing elements to form pivot bearings for the shaving head frame, and wherein the shaving head frame is held in abutment with the end surface of each of the bearing elements by a respective one of the biased springs which has one of its ends resting against the respective bearing screw while its other end is supported by the shaving head frame.

2. The dry shaving apparatus of claim 1 wherein each bearing screw includes a head portion, a bearing portion, a stop portion, and a thread portion, and each bearing element has a stop portion for abutment with the stop portion of the respective one of said bearing screws.

3. The dry shaving apparatus of claim 1 or claim 2 wherein the end surface of each bearing element protrudes outwardly from its respective support lug in a direction toward the shaving head frame.

4. The dry shaving apparatus of claim 2 wherein said thread of each bearing element is an internal thread extending through the thickness of the bearing element.

5. The dry shaving apparatus of claim 4 wherein the stop portion of each bearing element is provided in a transition area from the internal thread of the bearing element to the end surface of the bearing element protruding from the respective support lug, and wherein the stop portion of each bearing screw is provided adjacent to the thread portion of the bearing screw.

6. The dry shaving apparatus of claim 2 wherein each bearing element includes a blind-end bore having said thread.

7. The dry shaving apparatus of claim 6 wherein the stop portion of each bearing element is formed by an inner wall of the blind-end bore, and the stop portion of each bearing screw is formed by the end of the bearing screw lying ahead of the thread portion.

8. The dry shaving apparatus of claim 1 wherein each spring is arranged between an end wall inner surface of the shaving head frame and the head portion of the bearing screw.

9. The dry shaving apparatus of claim 1 wherein each spring is configured as a leaf spring having a bifurcated portion, embracing the bearing portion of the bearing screw and resting against the head portion of the bearing screw, and an angled spring leg, abutting a wall of the shaving head frame.

10. The dry shaving apparatus of claim 1 wherein each spring is configured as a spiral spring.

11. The dry shaving apparatus of claim 1 wherein each bearing element includes a mounting flange.

12. The dry shaving apparatus of claim 1 wherein each bearing element is press-fitted into the support lug.

13. The dry shaving apparatus of claim 1 wherein each bearing element is acted upon by a cover plate secured within a recess in the support lug.

* * * * *